US006750623B1

(12) United States Patent
McCauley et al.

(10) Patent No.: US 6,750,623 B1
(45) Date of Patent: Jun. 15, 2004

(54) REVERSIBLE AUTOMATIC FAN CONTROL SYSTEM

(75) Inventors: Thomas A. McCauley, Brimfield, IL (US); Bryan A. Vogt, Lockport, IL (US); James A. Morrison, Washington, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 10/320,747

(22) Filed: Dec. 17, 2002

(51) Int. Cl.[7] ..... H02P 1/22
(52) U.S. Cl. ..... 318/260; 318/280
(58) Field of Search ..... 318/260, 280; 388/934; 417/53

(56) References Cited

U.S. PATENT DOCUMENTS

| | | | | |
|---|---|---|---|---|
| 2,788,775 A | | 4/1957 | Steiner | |
| 3,786,891 A | | 1/1974 | Vogelaar et al. | |
| 4,160,487 A | | 7/1979 | Kunze et al. | |
| 4,339,014 A | | 7/1982 | Berth et al. | |
| 5,224,446 A | | 7/1993 | Okita et al. | |
| 5,364,332 A | * | 11/1994 | Gray, Jr. | 493/23 |
| 5,820,352 A | * | 10/1998 | Gunn et al. | 417/53 |
| 6,067,489 A | | 5/2000 | Letang et al. | |
| 6,076,488 A | | 6/2000 | Yamagishi | |
| 6,109,871 A | | 8/2000 | Nelson et al. | |

* cited by examiner

*Primary Examiner*—Karen Masih
(74) *Attorney, Agent, or Firm*—Finnegan, Henderson, Farabow, Garrett & Dunner

(57) ABSTRACT

A method of operating a fan control system associated with a radiator may include rotating a fan in a first direction at an operating speed to direct cool air toward the radiator for a first predetermined period of time. After expiration of the first predetermined period of time, rotation of the fan in the first direction may be decelerated. The method may also include accelerating the fan in a second direction opposite to the first direction and rotating the fan in the second direction at a predetermined speed for a second predetermined period of time. After expiration of the second predetermined period of time, rotation of the fan in the second direction may be decelerated, and the fan may then be accelerated in the first direction to the operating speed.

25 Claims, 3 Drawing Sheets

AIR FLOW
R
N
F

REVERSIBLE AUTOMATIC FAN CONTROL SYSTEM

TECHNICAL FIELD

This invention relates generally to a reversible fan associated with a radiator of a machine and, more particularly, to a reversible automatic fan control system and process.

BACKGROUND

Many types of machines that use an engine for motive power also include a radiator to supply a coolant, such as water, anti-freeze, or the like, to the engine to ensure that the engine does not overheat. The radiator is generally associated with a fan that supplies cooling air to the radiator. The radiator is normally positioned in front of the fan, and the fan normally draws air through the radiator to cool the liquid coolant for the engine.

In many types of applications, the machine is working or traveling in a dirty and/or trashy environment. As a result, debris such as dirt, insects, trash, and the like, becomes lodged in the radiator because the fan pulls air into the machine across the radiator. Thus, any debris included in the air that passes across the radiator may become, and often does become, lodged in the radiator.

It some machines, a hydraulic circuit, electrical circuit, or the like may be used to selectively switch the mode of operation of the cooling fan so that the cooling fan may be stopped, rotated forward, or rotated in reverse. For example, U.S. Pat. No. 6,076,488, to Yamagishi discloses a control device that may be used to rotate the cooling fan in reverse based on the temperature of the coolant. In particular, the control device rotates the cooling fan in reverse when the temperature of the coolant is not lower than a given temperature while the temperature of hydraulic oil is lower than a given temperature. This causes the back flow of air to discharge debris lodged in the radiator.

In this operation, however, the control device only rotates the cooling fan in reverse when the temperature of the cooling water is not lower than a given temperature of the hydraulic oil. While the fan reversal may discharge debris lodged in the radiator, this operation does not allow for automatic regular intervals of reversing the fan to dislodge debris in the radiator.

SUMMARY OF THE INVENTION

In accordance with an exemplary aspect of the invention, a method of operating a fan control system associated with a radiator may include rotating a fan in a first direction at an operating speed to direct air toward the radiator for a first predetermined period of time and, after expiration of the first predetermined period of time, decelerating rotation of the fan in the first direction. The method may also include accelerating rotation of the fan in a second direction to a predetermined speed, wherein the second direction is opposite to the first direction, rotating the fan in the second direction at the predetermined speed for a second predetermined period of time, and, after expiration of the second predetermined period of time, decelerating rotation of the fan in the second direction. The method may further include accelerating rotation of the fan in the first direction to the operating speed.

It is to be understood that both the foregoing general description and the following detailed description are exemplary and explanatory only and are not restrictive of the invention.

BRIEF DESCRIPTION OF THE DRAWINGS

The accompanying drawings, which are incorporated in and constitute a part of this specification, illustrate an exemplary embodiment of the invention and, together with the description, serve to explain the principles of the invention. In the drawings.

DETAILED DESCRIPTION

Reference will now be made in detail to exemplary embodiments of the invention, an example of which is illustrated in the accompanying drawings. Wherever possible, the same reference numbers will be used throughout the drawings to refer to the same or like parts.

Figure 1:
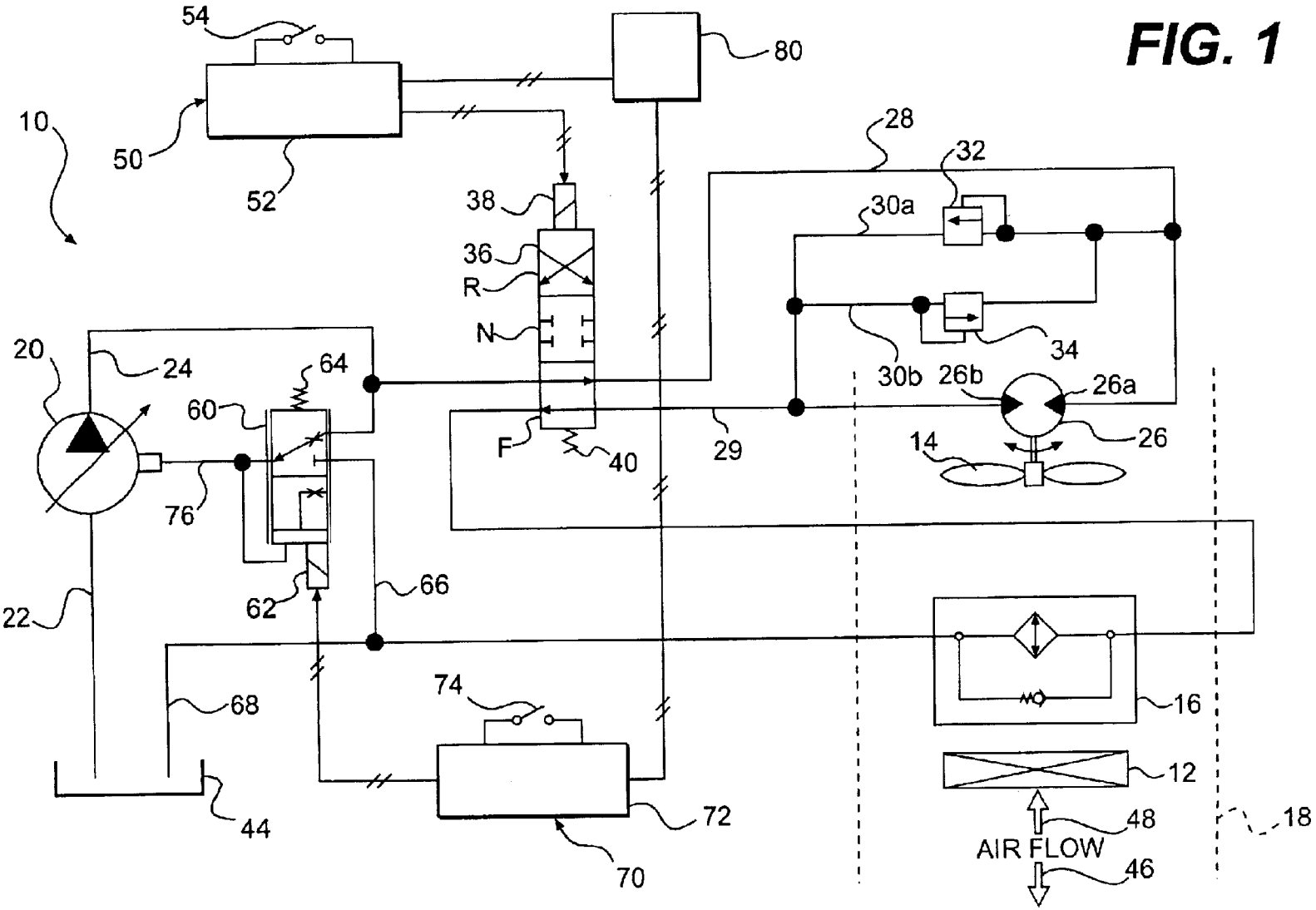
FIG. 1 is a schematic illustration of an exemplary reversible automatic fan control system in accordance with one embodiment of the invention.

FIG. 1 is a schematic illustration of a reversible automatic fan control system 10 according to an exemplary embodiment of the present invention. A radiator 12 disposed separately from the fan control system 10 is generally provided to cool a coolant, such as water, anti-freeze, or the like, for an engine (not shown) or another device of a machine (not shown) that needs to be cooled during operation. The fan control system 10 may include a cooling fan 14 and a hydraulic fluid cooler 16. The hydraulic fluid cooler 16 is generally provided to cool hydraulic fluid, such as oil, for operating the hydraulic equipment of the machine. The cooling fan 14 may be arranged to provide forced cooling to the radiator 12 and the hydraulic fluid cooler 16.

For example, the cooling fan 14 may be disposed in an air passage 18 such that the flow of air from the cooling fan 14 passes over the radiator 12 and the hydraulic fluid cooler 16 in a forward direction 46 when the cooling fan 14 is driven in a first direction. Conversely, when the cooling fan 14 is rotated in a second direction opposite to the first direction, air flows in a reverse direction 48 toward the cooling fan 14 from the radiator 12 and the cooler 16. The cooling fan 14 can be stopped, driven in a first, forward rotation, or driven in a second, reverse rotation.

The fan control system 10 may include a pressurized fluid source, for example, a pressure-sensing, variable-displacement hydraulic pump 20, a fluid-operated motor, for example, a reversible hydraulic motor 26, and a fluid reservoir, or tank, 44. The motor 26 may include a first port **26*a* and a second port 26*b*. The fan control system 10 may also include a first valve, for example a directional control valve 36, capable of reversing rotation of the fan 14 by selectively directing pressurized fluid from the pump 20 to the first port 26*a* or the second port 26*b*. In an exemplary embodiment, the first valve 36 may be a solenoid actuated directional control valve. The fan control system 10 may also include a second valve, for example, a variable control valve 60, capable of increasing and decreasing the speed of rotation of the cooling fan 14 in either direction. The variable control valve 60 may be, for example, a pressure reducing valve operative to provide a pressure signal to the pump 20 in order to increase and decrease the rotational speed of the cooling fan 14** as desired.

The pump 20 may be adapted to be rotated by a motor, for example, of an engine (not shown). The pump 20 may be fluidly connected to the reservoir 44 via a hydraulic line 22 so that hydraulic fluid may be supplied to the pump 20 from the reservoir 44. The pump 20 may also be fluidly connected to the directional control valve 36 and the variable control valve 60 via a hydraulic line 24 so that hydraulic fluid may be supplied to the valves 36, 60 from the fluid pump 20.

The pump 20 may supply fluid to a first port 26*a* of the motor 26 through the directional control valve 36 and via a hydraulic line 28. The pump 20 may supply fluid to a second port 26*b* of the motor 26 through the directional control valve 36 and via a hydraulic line 29. In one exemplary embodiment, the hydraulic circuit 10 may include two relief valves 32, 34 positioned in hydraulic lines 30*a*, 30*b*, respectively. The hydraulic lines 30*a*, 30*b* are fluidly connected with the hydraulic lines 28, 29. If the fluid pressure becomes too great such that the motor 26 could be damaged, the appropriate relief valve 32, 34, depending on the position of the directional control valve 36, may allow hydraulic fluid to bypass the motor 26 and travel through the respective hydraulic line 30*a*, 30*b*.

The directional control valve 36 may control the direction of rotation of the motor 26. As stated above, the directional control valve 36 may be disposed in the fan control system 10 between the pump 20 and the motor 26. The directional control valve 36 may be, for example, a 3-position, 4-port valve having a neutral position N for stopping the fan, a forward position F for rotating the fan in the first, forward direction, and a reverse position R for rotating the fan in the second, reverse direction. Thus, the directional control valve 36 is capable of stopping the motor 26, rotating the motor 26 forward, or rotating the motor 26 in reverse.

In order to stop or rotate the motor 26 forward or in reverse, a spool valve element (not shown) of the directional control valve 36 may be moved according to the relationship between a biasing force of a return spring 40 and an opposing force generated by a solenoid 38. For example, the solenoid 38 may be selectively, electrically energized to create the opposing force that acts in a direction opposite to the biasing force of the spring 40. The directional control valve 36 may thereby cut off or control the flow direction of fluid being fed from the pump 20 to the motor 26. When the directional control valve 36 is in the forward position F, the valve 36 directs pressurized fluid from the pump 20 to the first port 26*a* of the motor 26 via the hydraulic line 28. When the valve 36 is in the reverse position R, the valve 36 directs pressurized fluid from the pump 20 to the second port 26*b* of the motor 26 via the hydraulic line 29.

A control device 50 may be associated with the directional control valve 36. The control device 50 may be adapted to automatically shift the position of the directional control valve 36 to and from the neutral position N, the forward position F, and the reverse position R. The control device 50 may include a controller 52 electrically connected to the solenoid 38 of the directional control valve 36.

In one embodiment, a manual switch 54 may be associated with the control device 50. The manual switch 54 may stop automatic control of the directional control valve 36 and enable manual control. Thus, the cooling fan 14 may be rotated in reverse by manually shifting the directional control valve 36 to the reverse position R.

The variable control valve 60 may be provided to vary a fluid pressure signal communicated to the pump 20. Varying the fluid pressure signal supplied to the pump 20 in turn varies the fluid output from the pump 20 that is supplied to the motor 26 through the directional control valve 36. Varying the amount of fluid to the motor 26 causes rotation of the motor 26 to increase or decrease, which in turn causes the rotational speed of the cooling fan 14 to increase or decrease, respectively. The increase or decrease of the rotational speed of the cooling fan 14 may occur in both the first, forward direction and the second, reverse direction.

An output of the variable control valve 60 may be fluidly connected to the pump 20 via a hydraulic line 76 to supply the fluid pressure signal to the pump 20 in the variable manner. The valve 60 may be connected, via hydraulic lines 66 and 68, with the reservoir 44 so that hydraulic fluid may also be drained from the valve 60 to the reservoir 44. The valve 60 may also include a solenoid 62 and a spring 64. A control device 70 may be provided for controlling the valve 60 to vary the fluid pressure signal to the pump 20. The control device 70 may include a controller 72 and a manual switch 74. An output terminal of the controller 70 may be electrically connected to the solenoid 62 of the variable control valve 60. In conjunction with a computer algorithm, the controller 70 may vary electrical current supplied to the solenoid 62 in order to vary the fluid pressure signal to the pump 20, which in turn may vary the fluid output from the pump 20.

The system 10 may include a main controller 80 configured to analyze system parameters and/or send commands to the control devices 50, 70. It should be appreciated that the controller 80 and the control devices 50, 70 may be combined. It should also be appreciated that the controller 80 may be a computer or interfaced with a computer.

Figure 2:
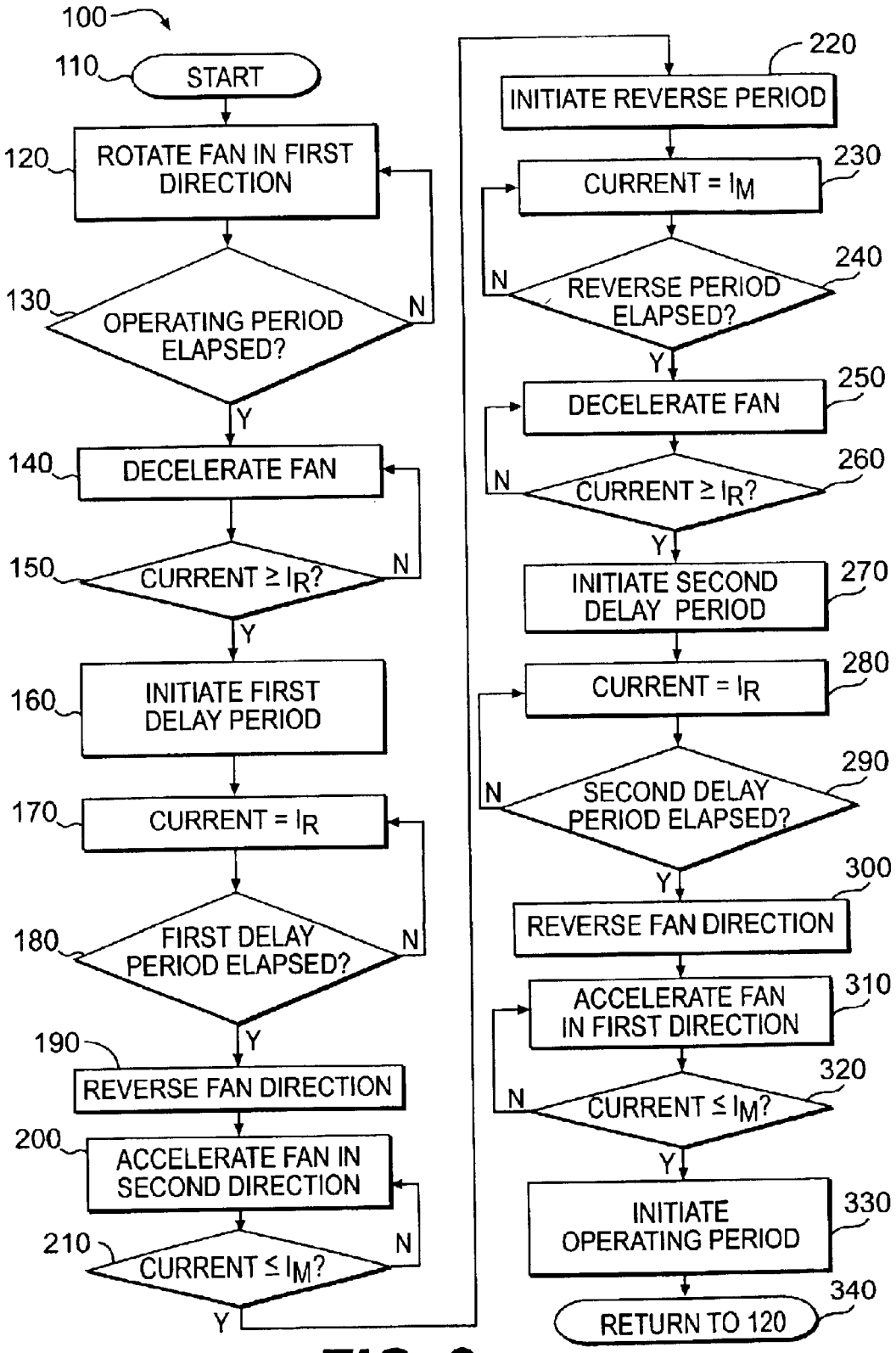
FIG. 2 is a flow chart of an exemplary reversible automatic fan control process in accordance with one embodiment of the invention.

Referring to FIG. 2, an exemplary embodiment of a reversible automatic fan control process 100 in accordance with the present invention will be described. In step 110, the engine (not shown) of a machine is started after the machine is turned on. During the exemplary process 100, the machine may be stopped or traveling. If stopped, the machine may be in a work operation.

In step 120, after the engine is started, the cooling fan 14 may be rotated in the first direction at a normal operating speed $V_N$. The first direction may be, for example, the direction that generates air flow in the forward direction 46, i.e., in a direction that supplies cooling air to the radiator 12. While rotating in the first direction, the cooling fan 14 may supply cooling air to the radiator 12. The controller 80 may rotate the fan 14 at the normal operating speed $V_N$ by directing a normal operating current $I_N$ to the solenoid 62 of the variable valve 60. The normal operating speed $V_N$ may be any speed, not exceeding a maximum rotational speed $V_{MAX}$ of the fan 14, determined in accordance with a fan control strategy that maintains the temperature of the radiator 12 in a desired operating range. The maximum rotational speed $V_{MAX}$ may be determined by the mechanical and hydraulic limitations of the fan 14. Control continues to step 130.

Then, in step 130, the controller 80 determines whether a first predetermined period A, or normal operating period, has elapsed. If period A has elapsed, control continues to step 140. Otherwise, if period A has not elapsed, control returns to step 130.

In step 140, when the controller 80 determines that period A has elapsed, the rotation of the cooling fan 14 in the first direction is decelerated by increasing current to the solenoid 62 of the variable control valve 60 at a first predetermined ramp rate. The first ramp rate may be selected so as to reach an appropriate reversing speed $V_R$ as quickly as possible, while maintaining hydraulic and mechanical stability of the fan control system 10. Similarly, the appropriate reversing speed $V_R$ may be selected so as to minimize the period of time spent reversing the cooling fan 14, while maintaining hydraulic and mechanical stability of the fan control system 10. For example, although slowing the fan 14 to a stop before reversing may provide greater hydraulic and mechanical stability, the time it would take to completely stop the fan may lead to undesirable temperatures at the radiator 12 and the cooler 16. Thus, when determining an appropriate reversing speed $V_R$, an appropriate tradeoff may be made between the hydraulic and mechanical stability of the cooling fan 14 and the time spent reversing the cooling fan 14. Control then continues to step 150.

It should be appreciated that the ramp rate of electrical current to the solenoid 62 of the variable control valve 60 is inversely proportional to the acceleration of the cooling fan 14. That is, as the current to the solenoid 62 is increased, the cooling fan 14 is decelerated, and as the current to the solenoid 62 is decreased, the cooling fan 14 is accelerated. For example, as the amount of electrical current to the solenoid 62 increases, the amount of fluid output from the pump 20 decreases. As the fluid output from the pump 20 decreases, the rotational speed of the motor 26 decreases, which in turn decelerates the cooling fan 14. The reverse is true when the current to the solenoid 62 is decreased.

It should also be appreciated that the rotational speed of the cooling fan 14 is inversely proportional to the current supplied to the solenoid 62 of the variable control valve 60. However, the rotational speed of the cooling fan 14 does not increase and decrease instantaneously, as does the current to the solenoid 62, since the cooling fan 14 and the motor 26 each have a mass that results in a momentum that must be overcome when decelerating and a moment of inertia that must be overcome when accelerating.

In step 150, the controller 80 determines whether the current being sent to the solenoid 62 of the variable control valve 60 has reached a reversing current $I_R$ corresponding to the reversing speed $V_R$ of the cooling fan 14. If the current being sent to the solenoid 62 has reached the reversing current $I_R$, control continues to step 160. Otherwise, if the current being sent to the solenoid 62 has not reached the reversing current $I_R$, control returns to step 140.

In step 160, after the controller 80 determines that the current being sent to the solenoid 62 has reached the reversing current $I_R$, the controller 80 initiates a first predetermined delay period to allow the cooling fan 14 to decelerate to the reversing speed $V_R$. Then, in step 170, the controller 80 maintains the supply of the reversing current $I_R$ to the solenoid. Control continues to step 180.

Then, in step 180, the controller 80 determines whether the delay period has elapsed. If the delay period has elapsed, control continues to step 190. Otherwise, if the delay period has not elapsed, control returns to step 170.

In step 190, when the controller 80 determines that the delay period has elapsed, the rotational direction of the cooling fan is reversed to a second direction opposite to the first direction. The second direction may be, for example, the direction that generates air flow in the reverse direction 48, i.e., in a direction that draws air from the radiator 12. For example, the cooling fan 14 may be reversed to the second direction when the controller 80 actuates the solenoid 38 of the directional control valve 36 to move the valve 36 to its reverse position R. Control continues to step 200.

Then, in step 200, the rotational speed of the fan 14 in the second direction is accelerated by decreasing current to the solenoid 62 of the variable control valve 60 at a second predetermined ramp rate. The second ramp rate may be selected so as to reach a predetermined reverse speed $V_M$, for example, a maximum reverse speed, as quickly as possible, while maintaining hydraulic and mechanical stability of the fan control system 10. Similarly, the predetermined reverse speed $V_M$ may be selected so as to minimize the period of time that the cooling fan 14 needs to clear debris from the radiator 12. In an embodiment, the predetermined reverse speed $V_M$ may be the maximum fan speed $V_{MAX}$. Control then continues to step 210.

In step 210, the controller 80 determines whether the current being sent to the solenoid 62 of the variable control valve 60 has reached a minimum current $I_{MIN}$ corresponding to the predetermined reverse speed $V_M$ of the cooling fan 14. If the current being sent to the solenoid 62 has reached the minimum current $I_{MIN}$, control continues to step 220. Otherwise, if the current being sent to the solenoid 62 has not reached the minimum current $I_{MIN}$, control returns to step 200.

Then, in step 220, after the controller 80 determines that the current being sent to the solenoid 62 has reached the minimum current $I_{MIN}$, the controller 80 initiates a second predetermined period, or reverse period. Then, in step 230, the controller 80 maintains the supply of the minimum current $I_{MIN}$ to the solenoid. During the reverse period, the cooling fan 14 may be rotated in the second direction at any speed not exceeding the maximum rotational speed $V_{MAX}$ of the cooling fan 14. Control continues to step 240.

In step 240, the controller 80 determines whether the reverse period has elapsed. If the reverse period has elapsed, control continues to step 250. Otherwise, if the reverse period has not elapsed, control returns to step 230.

In step 250, when the controller 80 determines that the reverse period has elapsed, the rotation of the cooling fan 14 in the second direction is decelerated by increasing current to the solenoid 62 of the variable control valve 60 at a third predetermined ramp rate. The third ramp rate may be selected so as to reach the appropriate reversing speed $V_R$ as quickly as possible, while maintaining hydraulic and mechanical stability of the fan control system 10. Alternatively , rotation of the cooling fan 14 may be decelerated to a second appropriate reversing speed different from the appropriate reversing speed $V_R$. Similarly, the second appropriate reversing speed may be selected so as to may be selected so as to minimize the period of time spent reversing the cooling fan 14, while maintaining hydraulic and mechanical stability of the fan control system 10. Control then continues to step 260.

Then, in step 260, the controller 80 determines whether the current being sent to the solenoid 62 of the variable control valve 60 has reached the reversing current $I_R$ corresponding to the reversing speed $V_R$ of the cooling fan 14. If the current being sent to the solenoid 62 has reached the reversing current $I_R$, control continues to step 270. Otherwise, if the current being sent to the solenoid 62 has not reached the reversing current $I_R$, control returns to step 250.

In step 270, after the controller 80 determines that the current being sent to the solenoid 62 has reached the reversing current $I_R$, the controller 80 initiates a second predetermined delay period to allow the cooling fan 14 to decelerate to the reversing speed $V_R$. Then, in step 280, the controller 80 maintains the supply of the reversing current $I_R$ to the solenoid. Control continues to step 290.

Then, in step 290, the controller 80 determines whether the second delay period has elapsed. If the second delay period has elapsed, control continues to step 300. Otherwise, if the second delay period has not elapsed, control returns to step 280.

In step 300, when the controller 80 determines that the second delay period has elapsed, the rotational direction of the cooling fan is reversed back to the first direction. Control then continues to step 310.

Then, in step 310, the rotational speed of the fan 14 in the first direction is accelerated by decreasing current to the solenoid 62 of the variable control valve 60 at a fourth predetermined ramp rate. The fourth ramp rate may be selected so as to reach the normal operating speed $V_N$ as quickly as possible, while maintaining hydraulic and mechanical stability of the fan control system 10. Control then continues to step 320.

In step 320, the controller 80 determines whether the current being sent to the solenoid 62 of the variable control valve 60 has reached a normal operating current $I_N$ corresponding to the normal operating speed $V_N$ of the cooling fan 14. If the current being sent to the solenoid 62 has reached the normal operating current $I_N$, control continues to step 330. Otherwise, if the current being sent to the solenoid 62 has not reached the normal operating current $I_N$, control returns to step 310.

In step 330, after the controller 80 determines that the current being sent to the solenoid 62 has reached the normal operating current $I_N$, the controller 80 initiates the predetermined normal operating period A and control continues to step 340. Then, in step 340, control is returned to step 120.

Generally, a computer (not shown) may be provided in association with the machine. The computer may contain one or more algorithms that include certain parameters of the control process 100, such as the predetermined normal operating period A, the predetermined delay time, the predetermined reverse period, the predetermined ramp rate(s), and the predetermined currents. In an alternative embodiment, these parameters may be inputted to the algorithm by the operator of the machine. A timing device (not shown) may be associated with the algorithm contained within the computer to monitor the elapsed time in conjunction with the control process 100.

In an exemplary embodiment, the computer may include a demand fan algorithm and a reversing fan algorithm, both utilized to control the direction of rotation, as well as the speed of rotation, of the cooling fan. The computer may use the demand fan algorithm during normal operation of the machine. After the time A has elapsed, the computer may then switch to the reversing fan algorithm to slow down the rotation of the fan, reverse the rotation of the fan for the period of time C, again slow down the rotation of the fan, and again reverse the cooling fan back to the forward rotation. The computer may switch back to the demand fan algorithm for the period of time A when the cooling fan rotates in the forward direction.

Figure 3:
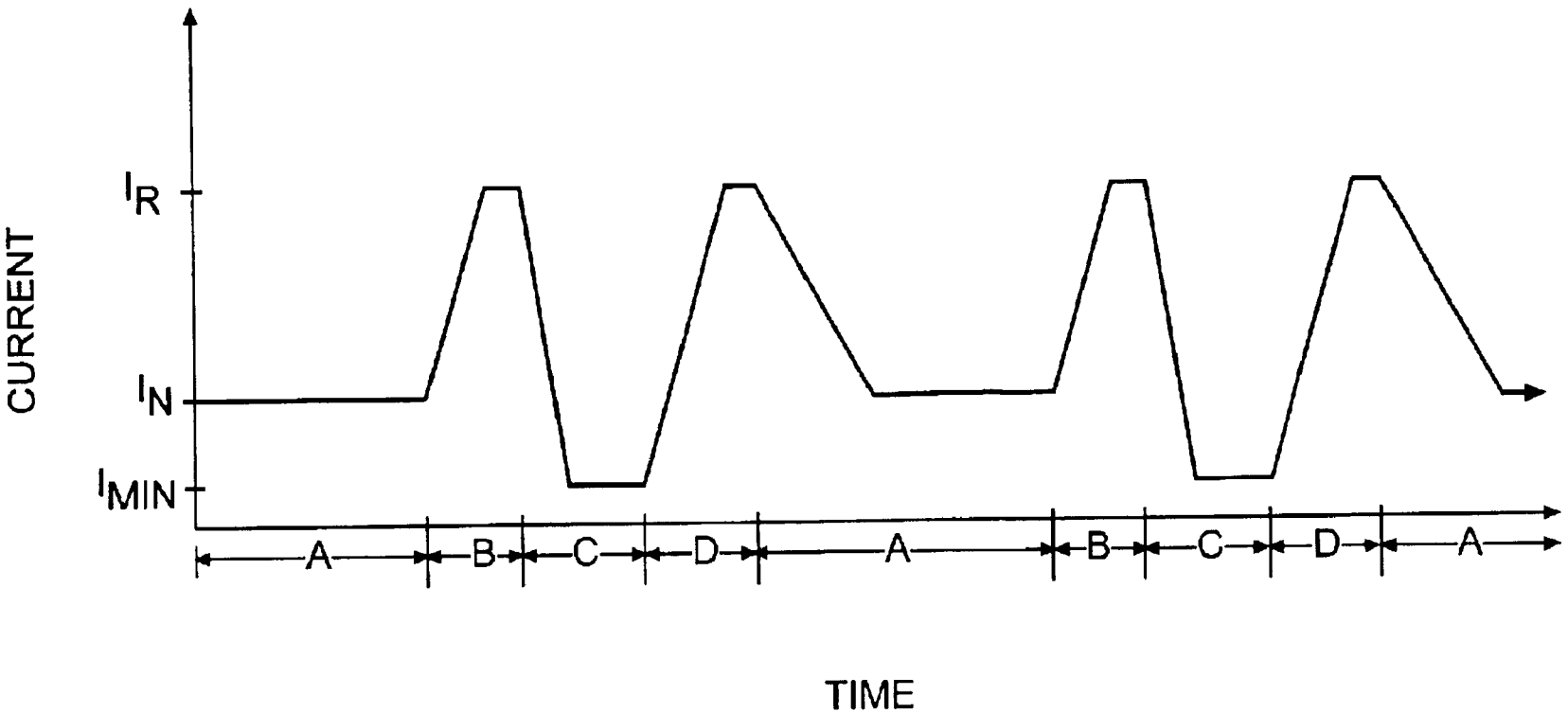
FIG. 3 is a graph showing electrical current versus time for the exemplary reversible automatic fan control process of FIG. 2.

FIG. 3 is a graph showing the electrical current traveling to the solenoid 62 of the variable control valve 60 versus time during the control process 100. This graph includes periods of forward rotation (periods A and B) and reverse rotation (periods C and D).

INDUSTRIAL APPLICABILITY

Referring now to FIGS. 1 and 2, operation of the reversible fan control system 10 will now be discussed in detail. Generally, the "normal" operation of the machine includes rotating the cooling fan 14 to generate air flow in the forward direction 46. In one exemplary embodiment, this may be accomplished by using the demand fan algorithm. To rotate the fan 14 in the forward direction, the directional control solenoid valve 36 is in its forward position F. During "normal" operation, period A in FIG. 3, the fan 14 generally rotates at a substantially constant speed because the electrical current to the variable control valve 60 is a substantially constant "normal" current $I_N$. It should be appreciated that the normal fan speed and the normal current $I_N$ may vary from machine to machine.

It should also be appreciated that the predetermined period of time A in which the cooling fan 14 rotates in the forward direction at a normal speed varies from machine to machine. For example, period A may range from about 0 minutes to about 240 minutes. In one exemplary embodiment, for example, period A may be about 20 minutes. In another exemplary embodiment, period A may be about 30 minutes. Period A may represent a period of time when it is expected that an amount of debris will have become lodged in the radiator 12 such that rotating the cooling fan 14 in the reverse direction to dislodge the debris may be necessary, beneficial, and/or efficient.

The cooling fan 14 may be rotated to generate air flow in the forward direction 46 until the controller 80 determines that period A has passed. After period A has passed, the controller 80 sends a signal to decrease the rotational speed of the fan in the forward direction. In order to achieve the desired rotational deceleration of the fan from the normal speed to an appropriate reversing speed, the controller 80 may send a signal to the control device 70 to increase the electrical current to the variable control valve 60 from the normal current $I_N$ to the reversing current $I_R$ at the first predetermined ramp rate It should be appreciated that the reversing current $I_R$ may vary depending on the machine. For example, the reversing current $I_R$ may range from about 0.0 amps to about 5.0 amps. In an exemplary embodiment, the reversing current $I_R$ may be about 1.5 amps. In another exemplary embodiment, the reversing current $I_R$ may be about 1.8 amps. The reversing current $I_R$ may be a parameter of the reversing algorithm or it may be inputted by the machine operator.

The cooling fan 14 is decelerated from the normal operating speed $V_N$ to the reversing speed $V_R$ over a period of time B. During period B, the current to the solenoid 62 is ramped down to the reversing current $I_R$ and the first delay period elapses. Period B may vary from machine to machine. For example, period B may range from about 0 seconds to about 30 seconds. In an exemplary embodiment, period B may be about 2 seconds. In another exemplary embodiment, period B may be about 5 seconds.

After the cooling fan 14 has been decelerated to the reversing speed $V_R$, the controller 80 may send a signal to the control device 50 to activate the directional control valve 36 to shift the position of the directional control valve 36 to its reverse position R. This reverses the rotational direction of the cooling fan 14 to generate air flow in the reverse direction 48.

After the rotational direction of cooling fan 14 is reversed, the controller 80 may then send a signal to accelerate the rotation of the cooling fan 14 in the reverse direction. In order to achieve the desired rotational acceleration from the appropriate reverse speed to a predetermined speed, for example, a maximum speed, the controller 80 may send a signal to the control device 70 to decrease the electrical current to the variable control valve 60 from the reversing trip point current $I_R$ to a minimum current $I_{MIN}$ at the second predetermined ramp rate.

It should be appreciated that the minimum current $I_{MIN}$ may vary from machine to machine. For example, the minimum current $I_{MIN}$ may be about 0.4 amps. The second ramp rate may also vary from machine to machine. For example, the current may be ramped down at a rate ranging from about 0.0 amp/second to about 2.5 amps/second. In an exemplary embodiment, the second ramp rate may be about 1 amp/second.

Once the current to the fan reaches the minimum current $I_{MIN}$, the rotational speed of the cooling fan 14 will soon reach the predetermined reverse speed $V_M$. The predetermined reverse speed $V_M$ may be a high speed, for example, the maximum rotational speed $V_{MAX}$ of the cooling fan 14. The controller 80 may rotate the cooling fan 14 in the reverse direction for the predetermined reverse period. A period of time C represents the time that it takes to raise the speed of the cooling fan 14 from the reversing speed $V_R$ to the predetermined reverse speed $V_M$ and to dislodge debris from the radiator 12. Period C may vary from machine to machine. For example, period C may range from about 0 seconds to about 120 seconds. In an exemplary embodiment, period C may be about 20 seconds. In another exemplary embodiment, period C may be about 30 seconds.

Once the controller 80 determines that the reverse period has passed, the controller 80 may send a signal to decelerate the rotation of the cooling fan 14 in the reverse direction. In order to achieve the desired rotational deceleration from the predetermined speed, for example, the maximum speed, to the appropriate reverse speed, the controller 80 may send a signal to the control device 70 to increase the electrical current to the variable control valve 60 from the minimum current $I_{MIN}$ to the reversing current $I_R$ at the third predetermined ramp rate.

The cooling fan 14 is decelerated from the predetermined reverse speed $V_M$ to the reversing speed $V_R$ over a period of time D. During period D, the current to the solenoid 62 is ramped down to the reversing current $I_R$ and the second predetermined delay period elapses. Period D may vary from machine to machine. For example, period D may range from about 0 seconds to about 30 seconds. In an exemplary embodiment, period D may be about 2 seconds. In another exemplary embodiment, period D may be about 5 seconds.

Once the cooling fan 14 has been decelerated to the reversing speed $V_R$, the controller 80 may then send a signal to the control device 50 to activate the directional control valve 36 to shift the position of the valve 36 back to its forward position F. This reverses the rotational direction of the cooling fan 14 back to generating air flow in the forward rotation 46.

After the rotation of cooling fan 14 is reversed to generate air flow in the forward rotation 46, the controller 80 may send a signal to accelerate the rotation of the cooling fan 14. In order to achieve the desired rotational acceleration from the reverse speed to the normal speed, the controller 80 may send a signal to the control device 70 to decrease the electrical current to the variable control valve 60 from the reversing trip point current $I_R$ to the normal current $I_N$ at the fourth predetermined ramp rate.

In one embodiment, the controller 80 may send a signal to decrease the current to the variable control valve 60 to the same current that was going to the variable control valve 60 before the controller 80 began the automatic reversal procedure using the reversing fan algorithm. In an exemplary embodiment, the controller 80 may store the value for the current to the valve 60 at a time just before the controller 80 begins the automatic reversal of the rotation of the direction of the cooling fan 14. After the rotation of the direction of the cooling fan 14 is reversed back to the forward direction, the controller 80 may decrease the current to the valve 60 to the stored current value.

As described above, when the cooling fan 14 is rotated in reverse, debris lodged in the radiator 12 and the cooler 16 may be removed by the back flow of the cooling air through the radiator 12 and the cooler 16. Using the above method, air flowing in the reverse direction 48 may automatically clean clogged portions of the radiator 12 and the cooler 16 at regular time intervals.

In addition, the operator of the machine may manually dislodge debris by manually changing the rotation of the cooling fan 14 to the reverse direction. This occurs when the operator manually shifts the directional control valve 36 to its reverse position R by operating the manual switch 54. Therefore, in addition to the automatic cleaning, cleaning of clogged portions in the radiator 12 may be conducted whenever conditions require such a manual cleaning. Manual reversing of the cooling fan may or may not restart period A for the timing of automatic reversing. Further, shutting the machine off may or may not restart period A for the timing of automatic reversing.

As shown in FIG. 1, the operation of an exemplary embodiment of this invention may be implemented on one or more controllers 80. Controller 80 may include a general purpose or special purpose computer, a programmed microprocessor or microcontroller and peripheral integrated circuit elements, an ASIC or other integrated circuit, a hardware electronic or logic circuit such as a discrete element circuit, a programmable logic device such as a PLD, PLA, FPGA or PAL, or the like. In general, any device on which a finite state machine capable of implementing the flowchart shown in FIG. 2 can be used to implement the controller functions of this invention.

It will be apparent to those skilled in the art that various modifications and variations can be made in the fan control system without departing from the scope or spirit of the invention. Other embodiments of the invention will be apparent to those skilled in the art from consideration of the specification and practice of the invention disclosed herein. It is intended that the specification and examples be considered as exemplary only.

What is claimed is:

1. A method of operating a fan control system associated with a radiator, the method comprising:

rotating a fan in a first direction at an operating speed to direct air toward the radiator for a first predetermined period of time;

after expiration of the first predetermined period of time, decelerating rotation of the fan in the first direction;

accelerating rotation of the fan in a second direction to a predetermined speed, the second direction being opposite to the first direction;

rotating the fan in the second direction at the predetermined speed for a second predetermined period of time;

after expiration of the second predetermined period of time, decelerating rotation of the fan in the second direction; and accelerating rotation of the fan in the first direction to the operating speed.

2. The method of claim 1, wherein said predetermined speed is a maximum speed.

3. The method of claim 1, wherein said rotating a fan in a first direction includes supplying pressurized fluid to a first port of a motor, the motor being coupled with the fan.

4. The method of claim 3, wherein said decelerating rotation of the fan in the first direction includes reducing the supply of pressurized fluid to the first port of the motor.

5. The method of claim 4, wherein said reducing the supply of pressurized fluid includes reducing the output of a pressure-sensing pump.

6. The method of claim 5, further including increasing an electrical current to a solenoid valve, the solenoid valve being configured to provide a pressure input to the pressure-sensing pump.

7. The method of claim 4, wherein said rotating the fan in a second direction includes supplying pressurized fluid to a second port of the motor.

8. The method of claim 7, wherein said decelerating rotation of the fan in the second direction includes reducing the supply of pressurized fluid to the second port of the motor.

9. The method of claim 8, wherein said reducing the supply of pressurized fluid to the second port includes reducing the output of a pressure-sensing pump.

10. The method of claim 9, further including increasing an electrical current to a solenoid valve, the solenoid valve being configured to provide a pressure input to the pressure-sensing pump.

11. The method of claim 1, further including selectively supplying pressurized fluid to one of a first port of a motor and a second port of the motor to rotate the fan in one of the first direction and the second direction.

12. A machine, comprising:

a radiator;

a fan associated with the radiator, the fan being configured to direct air toward the radiator when the fan is rotated in a first direction and to draw air from a direction of the radiator when the fan is rotated in a second direction opposite to the first direction; and at least one controller configured to rotate the fan in the first direction at an operating speed for a first predetermined period of time and, after expiration of the first predetermined period of time, to decelerate rotation of the fan, the at least one controller being further configured to accelerate rotation of the fan in a second direction to a predetermined speed, to rotate the fan in the second direction at the predetermined speed for a second predetermined period of time, and, after expiration of the second predetermined period of time, to decelerate rotation of the fan in the second direction, the at least one controller also being configured to accelerate rotation of the fan in the first direction to the operating speed.

13. The machine of claim 12, wherein said predetermined speed is a maximum speed.

14. The machine of claim 13, further including a fluid-operated motor coupled to the fan, the motor having a first port and a second port;

a first valve operable to selectively supply pressurized fluid to one of the first port and the second port to rotate the fan in one of the first direction and the second direction; and a second valve operable to vary the supply of pressurized fluid to a selected one of the first port and the second port, wherein the at least one controller is configured to operate the first valve to supply pressurized fluid to the first port to rotate the fan in the first direction and to the second port to rotate the fan in the second direction, and wherein the at least one controller is configured to operate the second valve to accelerate and decelerate the fan.

15. The machine of claim 14, further including a pump configured to supply pressurized fluid to the motor.

16. The machine of claim 14, wherein the first valve includes a three-position directional control valve.

17. The machine of claim 16, wherein a first position of the directional control valve is arranged to direct pressurized fluid from the pump to the first port of the motor.

18. The machine of claim 17, wherein a second position of the directional control valve is arranged to direct pressurized fluid from the pump to the second port of the motor.

19. The machine of claim 15, wherein the pump is a variable-displacement, pressure-sensing pump.

20. The machine of claim 19, wherein the second valve is a variable control valve configured to supply a pressure signal to the variable-displacement, pressure-sensing pump.

21. The machine of claim 20, wherein the controller is configured to provide an electric current to the second valve to generate the pressure signal.

22. The machine of claim 21, wherein the supply of pressurized fluid from the pump decreases when the electric current to the second valve is increased.

23. The machine of claim 21, wherein the supply of pressurized fluid from the pump increases when the electric current to the second valve is decreased.

24. A machine, comprising:

a radiator;

a fan associated with the radiator, the fan being configured to direct air toward the radiator when the fan is rotated in a first direction and to draw air from a direction of the radiator when the fan is rotated in a second direction opposite to the first direction;

a fluid-operated motor coupled to the fan, the motor having a first port and a second port;

a pump configured to supply pressurized fluid to the motor;

a first valve operable to selectively supply pressurized fluid to one of the first port and the second port to rotate the fan in one of the first direction and the second direction;

a second valve operable to vary the supply of pressurized fluid to a selected one of the first port and the second port, and at least one controller configured to rotate the fan in the first direction at an operating speed for a first predetermined period of time and, after expiration of the first predetermined period of time, to decelerate rotation of the fan, the at least one controller being further configured to accelerate rotation of the fan in a second direction to a predetermined speed, to rotate the fan in the second direction at the predetermined speed for a second predetermined period of time, and, after expiration of the second predetermined period of time, to decelerate rotation of the fan in the second direction, the at least one controller also being configured to accelerate rotation of the fan in the first direction to the operating speed, wherein the at least one controller is configured to operate the first valve to supply pressurized fluid to the first port to rotate the fan in the first direction and to the second port to rotate the fan in the second direction, and wherein the at least one controller is configured to operate the second valve to accelerate and decelerate the fan.

25. The machine of claim 24, wherein said predetermined speed is a maximum speed.

* * * * *